US007430973B2

(12) United States Patent
Wakazono

(10) Patent No.: US 7,430,973 B2
(45) Date of Patent: Oct. 7, 2008

(54) THREAD TENSION MECHANISM AND SEWING MACHINE

(75) Inventor: Munehiro Wakazono, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/808,086

(22) Filed: Jun. 6, 2007

(65) Prior Publication Data

US 2007/0277716 A1 Dec. 6, 2007

(30) Foreign Application Priority Data

Jun. 6, 2006 (JP) ..... 2006-156864

(51) Int. Cl.
*D05B 47/04* (2006.01)
*D05B 73/00* (2006.01)

(52) U.S. Cl. ..... 112/254

(58) Field of Classification Search ..... 112/254, 112/255, 302; 242/149, 150 R, 153, 157 R
See application file for complete search history.

(56) References Cited

U.S. PATENT DOCUMENTS 3,667,414 A * 6/1972 Illes et al. ..... 112/254
4,803,936 A * 2/1989 Mikuni et al. ..... 112/254
5,216,970 A * 6/1993 Sakuma ..... 112/168
5,711,238 A * 1/1998 Matsuo et al. ..... 112/255
6,050,205 A * 4/2000 Terao ..... 112/254
6,145,457 A 11/2000 Imaeda et al.

FOREIGN PATENT DOCUMENTS

JP A 2000-045614 2/2000
JP A 2000-202182 7/2000

* cited by examiner

*Primary Examiner*—Ismael Izaguirre
(74) *Attorney, Agent, or Firm*—Oliff & Berridge, PLC

(57) ABSTRACT

A thread tension mechanism and a sewing machine includes a thread tension dial, a pair of thread tension discs and a dial shaft secured unrotatably to an element constituting a body of the thread tension mechanism and rotatably supporting the thread tension dial; and first and second coil springs mounted in intimate contact with an outer periphery of the dial shaft. The second coil spring is spaced from the first coil spring and wound in a same direction as the first coil spring; and a pair of non-confronting outer end portions positioned at both ends of the first coil spring and the second coil spring or a pair of inner end portions positioned at confronting ends of the first coil spring and the second coil spring are engaged with the thread tension dial so as to be unrotatable relative to the thread tension dial.

8 Claims, 5 Drawing Sheets

THREAD TENSION MECHANISM AND SEWING MACHINE

This application is based upon and claims the benefit of priority from the prior Japanese Patent Application 2006-156864, filed on, Jun. 6, 2006 the entire contents of which are incorporated herein by reference.

FIELD

The present disclosure is directed to a thread tension mechanism allowing adjustment of thread tension applied to a needle thread by user operation of a thread tension dial.

BACKGROUND

Conventionally, a lockstitch sewing machine and other types of sewing machines have provided thereto a thread supply path extending from a thread spool to an eye of a sewing needle via a thread take-up. A thread tension mechanism is provided between the thread spool and the thread take-up of the thread supply path. The thread tension mechanism includes a rotatable thread tension dial in disc shape and a pair of thread tension discs allowing adjustment of thread tension applied to the needle thread by user operation of the thread tension dial.

For example, a sewing machine described in JP 2000-202182 A (patent document 1) has an adjustment pin engaged with a helical slit defined in the thread tension dial, whereupon clockwise rotation of the thread tension dial by the user, a tension adjustment element is moved leftward via the adjustment pin to increase the spring force of the compression coil spring. This results in increase of pressure exerted by the pair of thread tension discs consequently increasing the thread tension applied to the needle thread passing between the thread tension discs. On the other hand, when the user rotates the thread tension dial in the counter clockwise direction, the spring force of the compression coil spring is decreased consequently decreasing the thread tension applied to the needle thread passing between the pair of thread tension discs.

The sewing machine described in patent document 1 has a thread tension dial which can be rotated clockwise/counterclockwise by user operation so that adjustments can be made to obtain optimized thread tension depending upon needle thread thickness, material or the desired sewing pattern. Frictional resistance is applied to the thread tension dial so that rotational position of the thread tension dial can be reliably maintained at the position that applies adjusted thread tension even during a sewing operation.

Generally, in order to apply frictional resistance to the thread tension dial, the distal end of a leaf spring secured to a body frame of the thread tension mechanism is engaged with a jagged milled portion (knurling portion) defined in the rear side of the thread tension dial. Alternatively, a wave spring washer may be placed between the thread tension dial and the main body of the thread tension mechanism.

However, in case of applying frictional resistance to the thread tension dial by engaging the distal end of the leaf spring with the milled portion of the thread tension dial, the leaf spring is provided in the outer side of the thread tension dial. Such requirement of additional space for providing the leaf spring is an impediment to realizing a compact thread tension mechanism.

On the other hand, in case of applying frictional resistance to the thread tension dial by placing the wave spring washer between the thread tension dial and the body frame of the thread tension mechanism, no additional space is required for providing the leaf spring. Thus, compact thread tension mechanism car be realized.

However, in employing the wave spring washer, as illustrated in FIG. 7, dimensional errors in the height of the wave spring washer leads to large variance in the operational force (frictional resistance exerted on the thread tension dial) of the thread tension dial. Thus, inconsistency is observed in the operational force of the thread tension dial.

Also, the user experiences difference in the operational force required for clockwise and counterclockwise rotation of the thread tension dial; whereupon clockwise rotation, the spring force of the compression coil spring is increased to increase thread tension and upon counterclockwise rotation, the spring force of the compression coil spring is decreased to reduce thread tension. Such difference in the operational feel of clockwise and counterclockwise rotation of the thread tension dial is uncomfortable for the user.

SUMMARY

An object of the present disclosure is to provide a thread tension mechanism and a sewing machine that eliminates inconsistencies in the operational force of the thread tension dial when the user manually rotates the thread tension dial and that further eliminates the difference in the operational force of the thread tension dial depending upon the rotational direction of the thread tension dial.

A thread tension mechanism of the present disclosure includes a thread tension dial that adjusts thread tension applied to a needle thread; a pair of thread tension discs allowing adjustment of thread tension applied to the needle thread by operation of the thread tension dial; a dial shaft secured unrotatably to an element constituting a body of the thread tension mechanism and rotatably supporting the thread tension dial; a first coil spring mounted in intimate contact with an outer periphery of the dial shaft; a second coil spring mounted in intimate contact with the outer periphery of the dial shaft in a position spaced from the first coil spring and being wound in a same direction as the first coil spring; and a pair of non-confronting outer end portions positioned at both ends of the first coil spring and the second coil spring or a pair of inner end portions positioned at confronting ends of the first and the second coil spring are engaged with the thread tension dial so as to be unrotatable relative to the thread tension dial.

According to such configuration, when the user rotates the thread tension dial clockwise or counterclockwise, either of the first or the second coil spring is placed in a winding state and the other is placed in an unwinding state. When an operational force equal to or greater than a slip torque (frictional resistance) of the coil spring is operated on the coil spring in the winding state, the thread tension dial is rotated clockwise or counterclockwise relative to the dial shaft along with the first and the second coil springs so as to adjust thread tension applied to the needle thread by the pair of thread tension discs.

Thus, since the slip torque of either of the first or the second coil spring in the winding state applies frictional resistance to the thread tension dial, inconsistencies in the operational force of the thread tension dial experienced when the user manually rotates the thread tension dial can be eliminated.

The dial shaft and the first and the second coil springs may be contained inside the cylindrical member provided integrally with the thread tension dial and the pair of outer ends or the inner ends of the first and the second coil springs may be engaged with the cylindrical member.

Such configuration simplifies mounting of the first and the second coil springs to the dial shaft and the engagement of the first and the second coil springs to the cylindrical member.

The first coil spring may be arranged to be wound when the thread tension dial is rotated in the direction to increase thread tension and the second coil spring to be wound when the thread tension dial is rotated in the direction to decrease thread tension. The slip torque of the first coil spring may be configured to be smaller than the slip torque of the second coil spring.

According to such configuration, unbalance between the operational force of clockwise rotation and counterclockwise rotation of the thread tension dial can be eliminated by configuring the difference of slip torque between the first and the second coil springs as required. Thus, operational feel in rotating the thread tension dial can be improved.

Also, the thread tension mechanism of the present disclosure includes a thread tension dial that adjusts thread tension applied to a needle thread; a pair of thread tension discs allowing adjustment of thread tension applied to the needle thread by operation of the thread tension dial; a dial shaft secured unrotatably to an element constituting a body of the thread tension mechanism and rotatably supporting the thread tension dial; a coil spring mounted in intimate contact with an outer periphery of the dial shaft; and a pair of outer end portions at both ends of the coil spring are engaged with the thread tension dial so as to be unrotatable relative to the thread tension dial.

According to such configuration, when the user rotates thread tension dial clockwise or counterclockwise, the coil spring is placed in the winding state. When an operational force equal to or greater than the slip torque (frictional resistance) of the coil spring in winding state is operated on the coil spring, the thread tension dial is rotated clockwise or counterclockwise relative to the dial shaft along with the coil spring so as to adjust thread tension applied to the needle thread by the pair of thread tension discs.

Thus, when the thread tension dial is rotated clockwise or counterclockwise, frictional resistance is applied to the thread tension dial by the slip torque of the coil spring in winding state, thereby eliminating the inconsistency in the operational force of the thread tension dial when the user manually rotates the thread tension dial.

Further, by configuring the slip torque of the coil spring as required, difference in the operational force depending on the rotational direction of the thread tension dial can be eliminated.

Also, the thread tension mechanism of the present disclosure may be provided in a sewing machine

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One embodiment of the present disclosure is described with reference to FIGS. 1 to 5.

Figure 5:
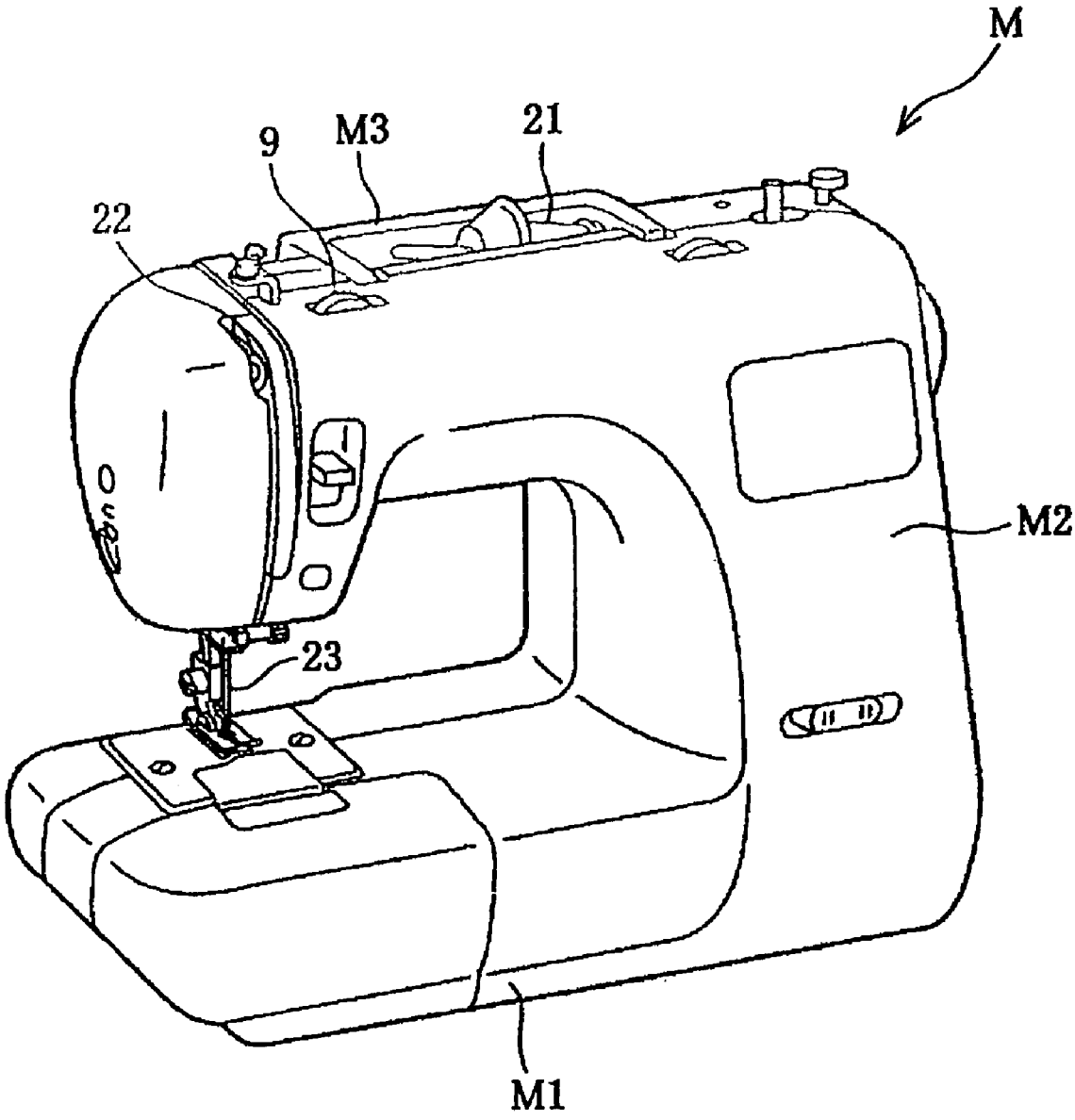
FIG. 5 is a perspective view of a lockstitch sewing machine in its entirety.

Referring to FIG. 5, a lockstitch sewing machine M includes a bed M1, a pillar M2 standing on the right end of the bed M1, and an arm M3 extending leftward from the upper end of the pillar M2 so as to confront the bed M1.

Provided in the arm M3 is a needle thread supply path (not shown) extending from a thread supply source such as a thread spool 21 to a sewing needle 23 via a thread take-up 22. A thread tension mechanism 2 (refer to FIGS. 1 and 2) is provided in the needle thread supply path; more specifically, in a position between the thread spool 21 and the thread take-up 22 of the needle thread supply path. The thread tension mechanism 2 adjusts tension applied to the needle thread existing in the needle thread supply path by the user's manual operation of the thread tension dial 9.

Figure 1:
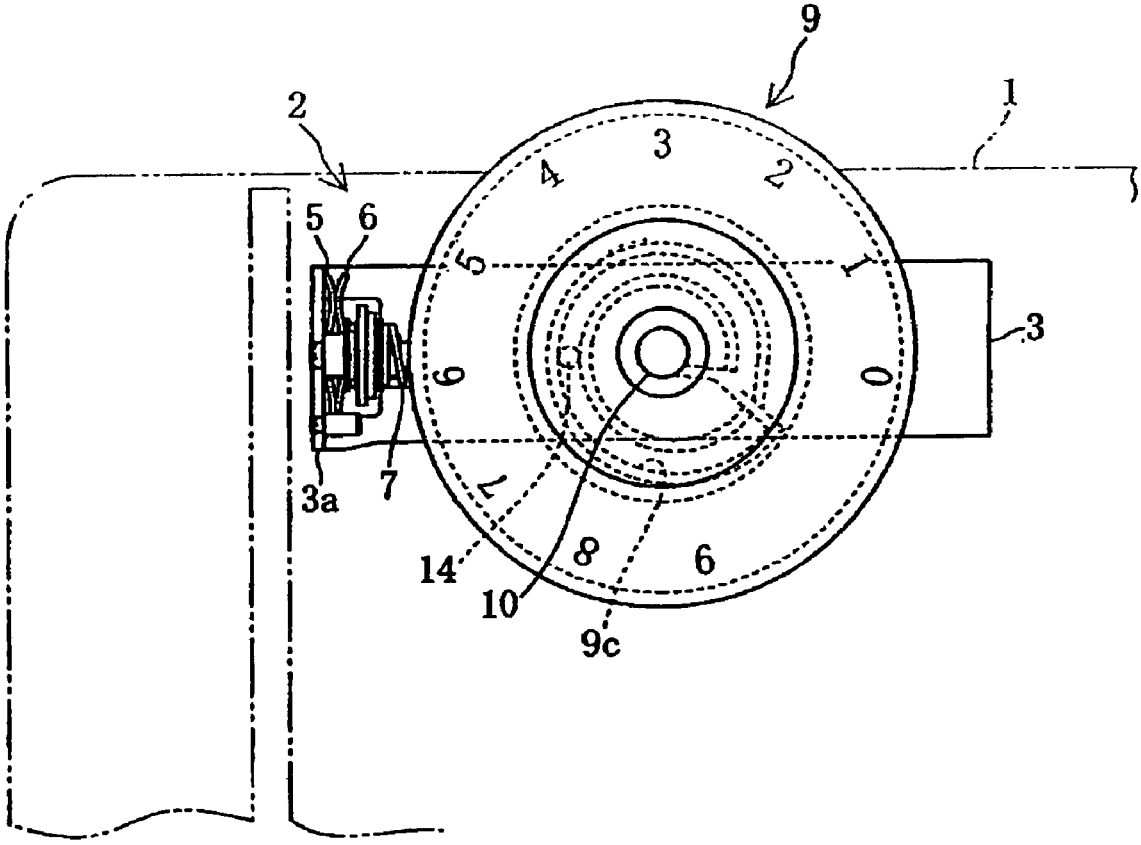
FIG. 1 is a front view of a thread tension mechanism according to a first illustrative aspect of the present disclosure.
Figure 2:
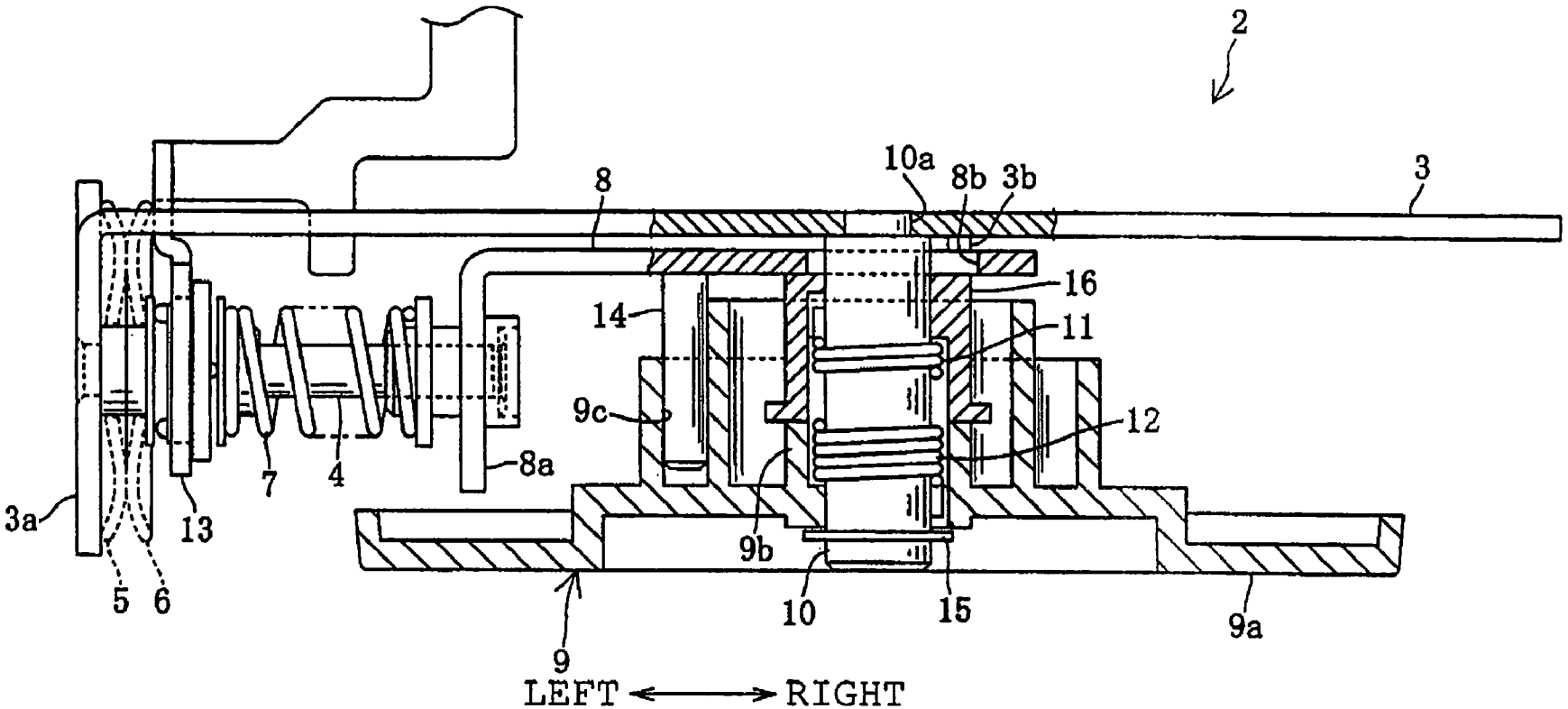
FIG. 2 is a plan view of a thread tension mechanism.

Referring to FIGS. 1 and 2, the thread tension mechanism 2 includes a thread tension bracket 3; a thread tension shaft 4; a pair of thread tension discs 5 and 6; a thread tension spring 7; a thread tension plate 8; a thread tension dial 9 in disc shape; a dial shaft 10; a first coil spring 11; and a second coil spring 12.

The thread tension bracket 3 taking an L-shape in plan view constitutes the body of the thread tension mechanism 2 and is secured in lateral orientation on a frame (not shown) of the arm 1. The left end of the thread tension bracket 3 is bent forward to define a support wall 3*a* to which the left end of the laterally oriented thread tension shaft 4 is secured. Secured at the right end of the thread tension shaft 4 is a coupling wall 8*a* of the thread tension plate 8 taking an L-shape in plan view. The thread tension shaft 4 has provided on the outer periphery thereof a pair of thread tension discs 5 and 6, a thread loosening plate 13, and the thread tension spring 7 in listed sequence from left to right.

A securing portion 10*a* formed at the rear end of the dial shaft 10 is inserted through a laterally elongate long hole 8*b* defined on the thread tension plate 8 and is further fitted into the thread tension bracket 3 to be secured thereto by caulking. A rear end of a forwardly projecting engagement pin 14 is secured on the thread tension plate 8; more specifically, at a portion between the long hole 8*b* and the coupling wall 8*a* by caulking.

The thread tension dial 9 is formed integrally by a dial operator 9*a* in disc-form; a cylindrical support 9*b* formed in a rearwardly projecting shape at a mid-portion of the thread tension dial 9; and a whorl groove cam 9*c* defined to extend approximately 360 degrees on the rear side of the dial operator 9*a*, and the like. The groove cam 9*c* define a whorl so that an engagement pin 14 engaged with the groove cam 9*c* moves radially outward by guidance of the groove cam 9*c*. Referring to FIG. 1, the front face of the thread tension dial 9 has numerical values "0" to "9" that indicate the size of thread tension applied to the needle thread marked thereon at predetermined intervals.

Figure 3:
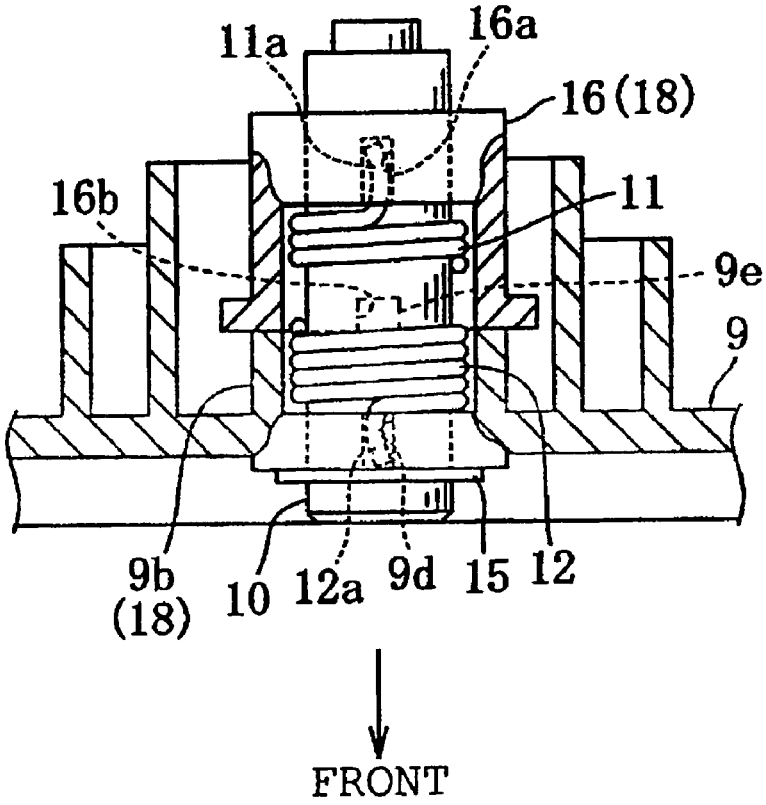
FIG. 3 is a partial plan view indicating a vertical cross section of a main portion of a thread tension dial.

Upon installing the thread tension dial 9 to the dial shaft 10, as shown in FIG. 3, a divided cylindrical member 16; the first coil spring 11; the second coil spring 12; and the thread tension dial 9 are fitted to the dial shaft 10 from the front side in listed sequence. Finally a stop ring 15 is fitted to the front end of the dial shaft 10.

At this time, the right-wound first coil spring 11 is intimately fitted on the rear side of the outer periphery of the dial shaft 10. A rear end engaging portion 11*a* of the first coil spring 11 is engaged with a second engagement subject portion 16*a* defined in the divided cylindrical member 16. The right-wound second coil spring 12 is intimately mounted on the front-side outer periphery of the dial shaft 10 and the front end engaging portion 12*a* of the second coil spring 12 is engaged with a first engagement subject portion 9*d* defined in the cylindrical support 9*b* of the thread tension dial 9.

The first and the second coil springs 11 and 12 have the same winding direction, material, thickness, and outer-diameter. Also, the cylindrical member 18 is composed of the cylindrical support 9*b* and the divided cylindrical member 16. The first coil spring 11 has a winding number of approximately three which is less by approximately two compared with the second coil spring 12 that has a winding number of approximately five. Thus, a slip torque of the first coil spring 11 is approximately 1 kgf·cm and the slip torque of the second coil spring 12 is approximately 2 kgf·cm which is approximately twice the slip torque of the first coil spring 11.

Further, a rearwardly projecting coupling projection 9*e* formed on the cylindrical support 9*b* is fitted to the forwardly recessed coupling recess 16*b* defined on the divided cylindrical member 16 and thus, the divided cylindrical member 16 is integrated with the cylindrical support 9*b* (refer to FIGS. 2 and 3).

The thread tension bracket 3 has a forwardly projecting emboss 3*b* formed thereto, and the thread tension plate 8 is located with respect to the thread tension bracket 3 by abutting the emboss 3*b* from the front side. Thus, the divided cylindrical member 16 and the thread tension dial 9 are located accurately by the thread tension plate 8 and the stop ring 15 without longitudinal rattle.

Further, the rear end engaging portion 11*a* in curved bend of the first coil spring 11 is engaged with a second engagement subject portion 16*a*, whereby the first coil spring 11 is located with respect to the dial shaft 10. Also, the front end engaging portion 12*a* in curved bend of the second coil spring 12 is engaged with the first engagement subject portion 9*d*, whereby the second coil spring 12 is located with respect to the dial shaft 10.

Next, a description will be given on the operation of the thread tension mechanism 2 having the above described configuration.

When executing a sewing operation, the user adjusts thread tension applied to the needle thread as required by rotating the thread tension dial 9 clockwise or counterclockwise depending on the material or the thickness of the needle thread used or depending on the desired sewing pattern.

In case the thread tension dial 9 is rotated clockwise, the front end engaging portion 12*a* of the second coil spring 12 is moved in an unwinding direction via the first engagement subject portion 9*d*, thereby placing the second coil spring 12 in the unwinding state. Thus, the spring force of the second coil spring 12 does not operate on the dial shaft 10. The divided cylindrical member 16 is rotated clockwise in synchronization with the thread tension dial 9. Thus, the rear end engaging portion 11*a* of the first coil spring 11 is moved in a winding direction via the second engagement subject portion 16*a*, and the first coil spring 11 is placed in the winding state.

At this time, the slip torque of the first coil spring 11 is approximately 1 kgf·cm. Thus, by clockwise rotation of the thread tension dial 9 by the user at an operational force equal to or greater than the slip torque, the thread tension dial 9 can be rotated clockwise via the first coil spring 11.

When the thread tension dial 9 is rotated clockwise, the groove cam 9*c* is integrally rotated clockwise as well. Thus, the thread tension plate 8 is moved leftward along with the leftward movement of the engagement pin 14 engaged with the groove cam 9*c*, thereby increasing the compression of the thread tension spring 7 and the pressure applied by the pair of thread tension discs 5 and 6, consequently increasing the thread tension applied to the needle thread. Supposing that average value of rotational torque when the thread tension dial 9 compresses the thread tension spring 7 is, for example, approximately 1 kgf·cm, the thread tension dial 9 is rotated by the user at an operational force of approximately 2 kgf·cm which is a sum of the average value of approximately 1 kgf·cm and the slip torque of the first coil spring 11 of approximately 1 kgf·cm.

On the other hand, in case the thread tension dial 9 is rotated counterclockwise, the divided cylindrical member 16 is rotated counterclockwise in synchronization with the thread tension dial 9. Thus, the rear end engaging portion 11*a* of the first coil spring 11 is moved in the unwinding direction via the second engagement subject portion 16*a* and the first coil spring 11 is placed in the unwinding state, thereby disallowing the operation of spring force of the first coil spring 11 to the dial shaft 10. However, since the cylindrical support 9*b* of the thread tension dial 9 is rotated counterclockwise, the front end engaging portion 12*a* of the second coil spring 12 is moved in the winding direction via the first engagement subject portion 9*d*, thereby placing the second coil spring 12 in the winding state.

At this time, the slip torque of the second coil spring 12 is approximately 2 kgf·cm. Thus, by counterclockwise rotation of the thread tension dial 9 by the user at an operational force equal to or greater than the slip torque, the thread tension dial 9 is rotated counterclockwise via the second coil spring 12.

When the thread tension dial 9 is rotated counterclockwise, the groove cam 9*c* is integrally rotated counterclockwise as well. Thus, the thread tension plate 8 is moved rightward along with the rightward movement of the engagement pin 14 engaging with the groove cam 9*c*, thereby reducing the compression of the thread tension spring 7 and the pressure applied by the pair of thread tension discs 5 and 6, consequently decreasing the thread tension applied to the needle thread. Since the thread tension spring 7 is placed in a state of decompression, the average value of rotational torque applied to the thread tension dial 9 by the thread tension spring 7 is almost negligible since it is very little compared to the slip torque of the second coil spring 12 of approximately 2 kgf·cm. Thus, the thread tension dial 9 is rotated at an operational force of approximately 2 kgf·cm equivalent to the slip torque of the second coil spring 12 by the user.

That is, regardless of whether the user has rotated the thread tension dial 9 clockwise to increase the thread tension applied to the needle thread, or counterclockwise 9 to decrease the thread tension applied to the needle thread, operational force is approximately 2 kgf·cm in either case, thereby substantially eliminating the deficit of operational force between the directions of rotation and eliminating discomfort in rotating the thread tension dial 9.

Figure 4:
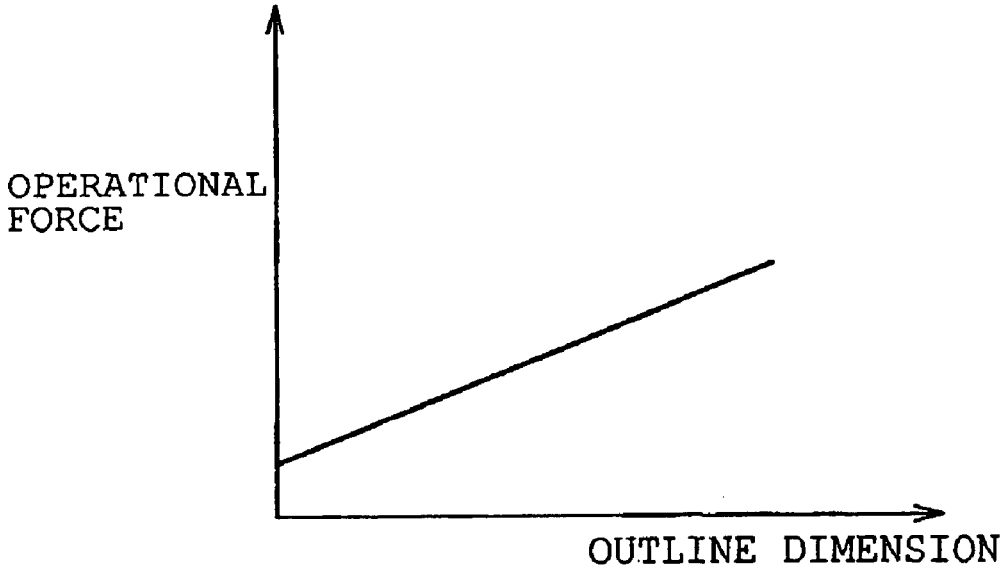
FIG. 4 indicates a relation between an outer dimension of a coil spring and an operational force of the thread tension dial.

Furthermore, referring to FIG.4, the variation of operational force of the thread tension dial 9 due to dimensional error of the first and the second coil springs 11 and 12 is little. Thus, inconsistency in operational force in rotating the thread tension dial 9 can be restrained to the possible extent.

As described above, according to the present embodiment, when the user rotates the thread tension dial 9 clockwise or counterclockwise, either of the first coil spring 11 or the second coil spring 12 is placed in the winding state and the other is placed in the unwinding state. When an operational force equal to or greater than the slip torque (frictional resistance) of the coil spring is operated on the coil spring in the winding state, the thread tension dial 9 is rotated clockwise or counterclockwise relative to the dial shaft 10 along with the first coil spring 11 and the second coil spring 12, thereby allowing adjustment of thread tension applied to the needle thread by the pair of thread tension discs 5 and 6. Moreover, when rotation of the thread tension dial 9 is stopped, either of the first coil spring 11 or the second coil spring 12 in the winding state is maintained in the winding state, whereas the coil spring in the unwinding state is returned to the winding state. That is, the first coil spring 11 and the second coil spring 12 are both placed in the winding state, thereby allowing the thread tension dial to maintain its rotational position.

Thus, since the slip torque of either of the first coil spring 11 or the second coil spring 12 in the winding state applies frictional resistance on the thread tension dial 9. Thus, inconsistency in the operational force of the thread tension dial 9 upon manual rotation of the thread tension dial 9 can be eliminated.

Further, the coil spring placed in the winding state differs (either the first coil spring or the second coil spring) depending upon whether the thread tension dial 9 is rotated clockwise or counterclockwise. Thus, the difference in the operational force depending on the rotational direction of the thread tension dial 9 can be eliminated by configuring the slip torque of the first coil spring 11 and the second coil spring 12 as required.

Also, the dial shaft 10, the first coil spring 11 and the second coil spring 12 have been contained inside the cylindrical member 18 provided integrally with the thread tension dial 9 and the pair of outer end portions of the first coil spring 11 and the second coil spring 12 have been engaged with the cylindrical member 18. Such configuration simplifies mounting of the first coil spring 11 and the second coil spring 12 to the dial shaft 10 and the engagement of the first coil spring 11 and the second coil spring 12 with the cylindrical member 18.

Further, the slip torque of the first coil spring 11, which is arranged to be wound when the thread tension dial 9 is rotated (clockwise rotation) in the direction to increase thread tension, has been configured to he smaller than the slip torque of the second coil spring 12, which is arranged to he wound when the thread tension dial 9 is rotated (counterclockwise rotation) in the direction to decrease thread tension. In this case, the difference in slip torque of the first coil spring 11 and the second coil spring 12 has been arranged at the magnitude of rotational torque applied by compression of the thread tension spring 7 when the thread tension dial 9 is rotated in the direction to increase thread tension. According to such configuration, the unbalance between the operational force of clockwise rotation and counterclockwise rotation of the thread tension dial 9 can be eliminated; thereby improving the operational feel in rotating the thread tension dial 9.

Next, a second embodiment of the present disclosure is described with reference to FIG. 6.

Figure 6:
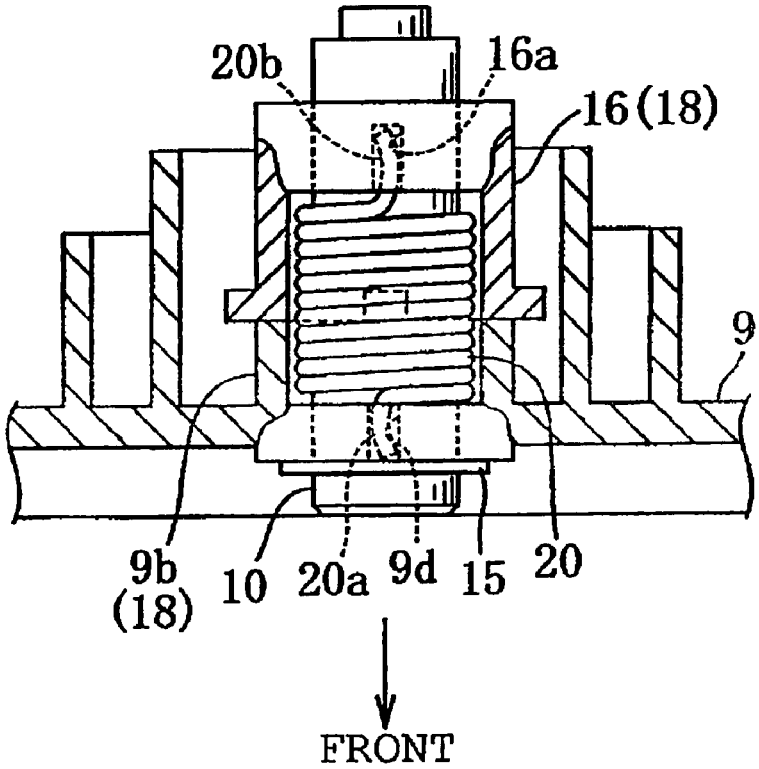
FIG. 6 illustrates a second illustrative aspect of the present disclosure and corresponds to FIG. 3.
Figure 7:
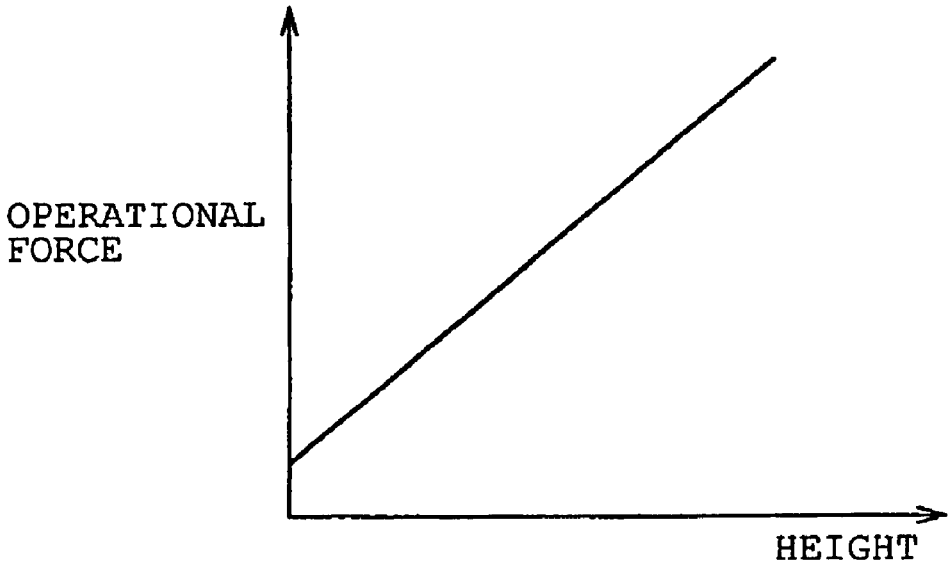
FIG. 7 indicates a relation between a height of a wave spring washer and an operational force of the thread tension dial observed in conventional art.

Referring to FIG. 6, a single, right wound coil spring 20 is attached in intimate contact with the outer periphery of the dial shaft 10. A front end engaging portion 20*a* provided in the front end of the coil spring 20 is engaged with the first engagement subject portion 9*d* of the cylindrical support 9*b*, whereas a rear end engaging portion 20*b* provided in the rear end portion of the coil spring 20 is engaged with a second engagement subject 16*a* of the divided cylindrical member 16.

Under such configuration also, when the thread tension dial 9 is rotated clockwise, the rear end engaging portion 20*b* of the coil spring 20 rotates the coil spring 20 in a winding direction via the second engagement subject portion 16*a*. However, the front end engaging portion 20*a* of the coil spring 20 does not wind the coil spring 20 via the first engagement subject portion 9*d*. Thus, the thread tension dial 9 can be rotated with a predetermined slip torque (slip torque of the coil spring 20) as in the aforementioned first embodiment.

On the other hand, when the thread tension dial 9 is rotated counterclockwise, the front end engaging portion 20*a* of the coil spring 20 rotates the coil spring 20 in the winding direction via the first engagement subject portion 9*d*. However, the rear end engaging portion 20*b* of the coil spring 20 does not wind the coil spring 20 via the second engagement subject portion 16*a*. Thus, the thread tension dial 9 can be rotated by a predetermined slip torque (slip torque of coil spring 20).

As described above, according to the present embodiment, when the user rotates the thread tension dial 9 clockwise or counterclockwise, the coil spring 20 is placed in the winding state. When an operational force equal to or greater than the slip torque (frictional resistance) of the coil spring 20 is applied to the coil spring 20 in the winding state, the thread tension dial 9 is rotated clockwise or counterclockwise relative to the dial shaft 10 along with the coil spring 20, allowing adjustment of thread tension applied to the needle thread by the pair of thread tension discs 5 and 6.

Moreover, when rotational operation of the thread tension dial 9 is stopped, the coil spring 20 is placed in the winding state and the thread tension dial 9 can be maintained in the rotational position where it has been stopped.

The present disclosure is not limited to the embodiments described above, but may be modified or expanded for example as follows.

In the first embodiment, the slip torque of the first coil spring 11 may be configured to be smaller than the slip torque of the second coil spring 12 by employing different thickness, material etc. to the first coil spring 11 as compared to the second coil spring 12.

The winding number of the first coil spring 11 relative to the second coil spring 12 may be changed as required depending upon the magnitude of increase in spring force in compressing the thread tension spring 7.

The pair of inner end portions positioned at confronting ends of the first coil spring 11 and the second coil spring 12 may be engaged with the thread tension dial 9 so as to be unrotatable with respect to the thread tension dial 9. In such case, the front end engaging portion is provided in the front end of the first coil spring 11, which front end engaging portion is engaged with the engagement subject portion of the divided cylindrical member 16. Also, the rear end engaging portion is provided in the rear end of the second coil spring 12, which rear end engaging portion is engaged with the engagement subject portion of the cylindrical support 9*b*.

In case the winding directions of the first coil spring 11 and the second coil spring 12 are not the same, the front end engaging portion of the first coil spring 11 may be engaged with the engagement subject portion of the divided cylindrical member 16 and the front end engaging portion of the second coil spring 12 may be engaged with the engagement subject portion of the cylindrical support 9*b*. Alternatively, the rear end engaging portion of the first coil spring 11 may be engaged with the engagement subject portion of the divided cylindrical element 16 and the rear end engaging portion of the second coil spring 12 may be engaged with the engagement subject portion of the cylindrical support 9*b*.

The first coil spring 11 and the second coil spring 12 is not limited to wire material having a circular cross section, but may also employ wire materials having rectangular or oval cross section.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A thread tension mechanism comprising:

a thread tension dial that adjusts thread tension applied to a needle thread;

a pair of thread tension discs allowing adjustment of thread tension applied to the needle thread by operation of the thread tension dial;

a dial shaft secured unrotatably to an element constituting a body of the thread tension mechanism and rotatably supporting the thread tension dial;

a first coil spring mounted in intimate contact with an outer periphery of the dial shaft;

a second coil spring mounted in intimate contact with the outer periphery of the dial shaft in a position spaced from the first coil spring and being wound in a same direction as the first coil spring; and a pair of non-confronting outer end portions positioned at both ends of the first coil spring and the second coil spring or a pair of inner end portions positioned at confronting ends of the first coil spring and the second coil spring are engaged with the thread tension dial so as to be unrotatable relative to the thread tension dial.

2. The mechanism of claim 1, further comprising:

a cylindrical member provided integrally with the thread tension dial and containing the dial shaft, the first coil spring, and the second coil spring therein, wherein either of the pair of outer end portions or the inner end portions of the first coil spring and the second coil spring are engaged with the cylindrical member.

3. The mechanism of claim 1, wherein the first coil spring is wound when the thread tension dial is rotated in a direction to increase thread tension and the second coil spring is wound when the thread tension dial is rotated in a direction to decrease thread tension, and a slip torque of the first coil spring is configured to be smaller than a slip torque of the second coil spring.

4. The mechanism of claim 2, wherein the first coil spring is wound when the thread tension dial is rotated in a direction to increase thread tension and the second coil spring is wound when the thread tension dial is rotated in a direction to decrease thread tension, and a slip torque of the first coil spring is configured to be smaller than a slip torque of the second coil spring.

5. A sewing machine comprising:

a thread tension mechanism allowing adjustment of thread tension applied to a needle thread, wherein the thread tension mechanism includes:

a thread tension dial that adjusts thread tension applied to the needle thread;

a pair of thread tension discs allowing adjustment of thread tension applied to the needle thread by operation of the thread tension dial;

a dial shaft secured unrotatably to an element constituting a body of the thread tension mechanism and rotatably supporting the thread tension dial;

a first coil spring mounted in intimate contact with an outer periphery of the dial shaft;

a second coil spring mounted in intimate contact with the outer periphery of the dial shaft in a position spaced from the first coil spring and being wound in a same direction as the first coil spring; and a pair of non-confronting outer end portions positioned at both ends of the first coil spring and the second coil spring or a pair of inner end portions positioned at confronting ends of the first coil spring and the second coil spring are engaged with the thread tension dial so as to be unrotatable relative to the thread tension dial.

6. The sewing machine of claim 5, wherein the thread tension mechanism further comprises a cylindrical member provided integrally with the thread tension dial and containing the dial shaft, the first coil spring, and the second coil spring therein, and wherein either of the pair of outer end portions or the inner end portions of the first coil spring and the second coil spring are engaged with the cylindrical member.

7. The sewing machine of claim 5, wherein the first coil spring is wound when the thread tension dial is rotated in a direction to increase thread tension and the second coil spring is wound when the thread tension dial is rotated in a direction to decrease thread tension, and a slip torque of the first coil spring is configured to be smaller than a slip torque of the second coil spring.

8. The sewing machine of claim 6, wherein the first coil spring is wound when the thread tension dial is rotated in a direction to increase thread tension and the second coil spring is wound when the thread tension dial is rotated in a direction to decrease thread tension, and a slip torque of the first coil spring is configured to be smaller than a slip torque of the second coil spring.

* * * * *